United States Patent [19]

Sellera

[11] 4,228,982

[45] Oct. 21, 1980

[54] HANGING DEVICE FOR PICTURES

[76] Inventor: Jose M. Sellera, 721 SW. 2 St., Miami, Fla. 33130

[21] Appl. No.: 11,302

[22] Filed: Feb. 12, 1979

[51] Int. Cl.[3] ..... A47F 7/14

[52] U.S. Cl. ..... 248/467; 33/370; 248/475 R; 312/245

[58] Field of Search ..... 248/542, 467, 479, 475R; 312/245; 33/370; 40/152.1

[56] References Cited

U.S. PATENT DOCUMENTS

| | | | |
|---|---|---|---|
| 3,052,436 | 9/1962 | Margulis | 248/467 |
| 3,063,666 | 11/1962 | Morrison | 248/467 X |
| 3,294,355 | 12/1966 | Topf | 248/467 |
| 3,311,435 | 3/1967 | Heritage | 312/245 |
| 3,358,959 | 12/1967 | Saling | 248/467 |
| 3,633,865 | 1/1972 | Hogg | 248/467 |
| 3,884,443 | 5/1975 | McMaster | 248/467 |
| 4,067,536 | 1/1978 | McBeth | 248/475 R |

*Primary Examiner*—James T. McCall

[57] ABSTRACT

A hanging device for pictures comprising a wall pad and a picture frame pad wherein the wall pad includes structure defining an upwardly opening pocket and is adapted to be adhered to a wall surface and wherein the picture pad includes a downwardly and outwardly extending portion sized for receipt in the wall pad in hooked-up engagement to support the picture and wherein a leveler bubble gauge may be provided on one or both of the pads to orient the pads into a horizontal attitude for correct display of the picture.

3 Claims, 6 Drawing Figures

HANGING DEVICE FOR PICTURES

FIELD OF THE INVENTION

This invention relates to a wall hanging device and, more particularly, to a wall hanging device which is easy and convenient to use to correctly mount a picture.

BACKGROUND OF THE INVENTION

It will be appreciated that it has often been difficult to mount a picture so that it is correctly displayed in a rather precise horizontal attitude. This invention is of a wall mounting device composed of a pair of mating members for hooked-up engagement one with the other for supporting a picture frame.

OBJECTS OF THE INVENTION

It is an object of this invention to provide an improved picture hanging device composed of a first member to be applied to a wall and a second member to be applied to a picture frame and which members are adapted for hooked-up engagement for quickly and easily displaying a picture in a correct attitude.

It is a general object of this invention to provide a wall hanging device of the type described hereinafter which is simple and inexpensive to manufacture and which is easy to use and which has other objects which will become apparent in view of the description and claims which follow.

In accordance with these and other objects which will become apparent hereinafter, the instant invention will now be described with reference to the accompanying drawings in which:

Figure 1:
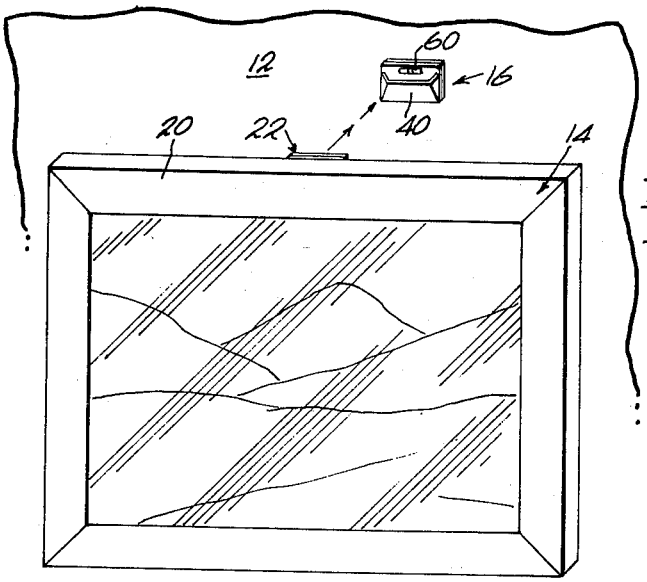
FIG. 1 is a perspective view illustrating the components of the instant invention in use.
Figure 2:
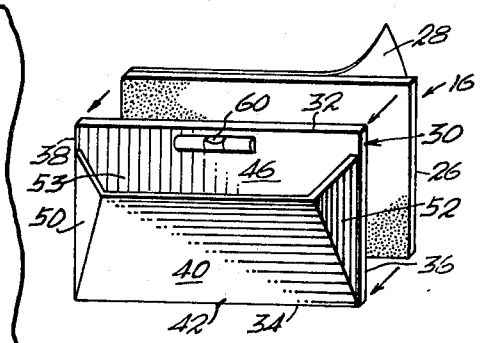
FIG. 2 is a perspective view of the pad designated by the numeral 16 in FIG. 1.
Figure 3:
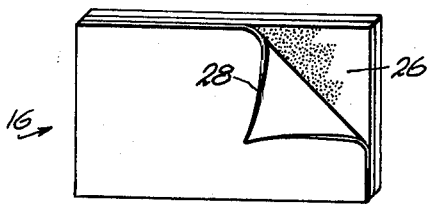
FIG. 3 is a rear view of the pad shown in FIG. 2.
Figure 4:
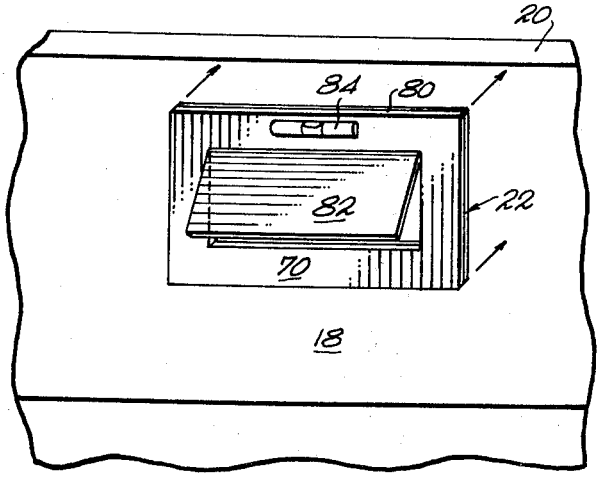
FIG. 4 is a rear view in perspective of a portion of the picture frame shown in FIG. 1 and illustrating the frame pad designated by the numeral 22 in FIG. 1.
Figure 6:
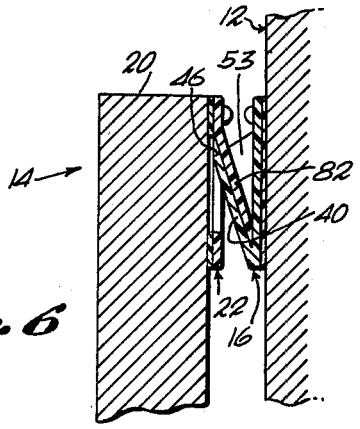
FIG. 6 is a view in cross section illustrating the pads in use.

DESCRIPTION OF THE PREFERRED EMBODIMENT:

Referring to the drawings, the numeral 12 generally designates a wall surface and the numeral 14 a picture to be mounted. To the wall a pad generally designated by the numeral 16 is applied and, as seen in FIG. 4, to the rear surface 18 of the frame member 20 a pad member 22 is applied. In use, these two pads are arranged in hooked-up relation as shown in FIG. 6.

Referring more in detail to the pad 16, that is, the wall pad, it is seen that it includes an inside double-sided pressure sensitive tape portion with the outer adhesive surface 26 provided with a liner 28 of waxed paper, for example. The pad also includes an outside portion 30.

Figure 5:
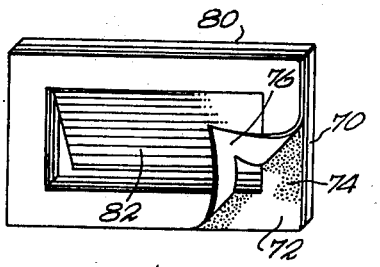
FIG. 5 is a rear view of the pad shown in FIG. 4.

The outside portion has an upper edge 32, a lower edge 34 and side edges 36 and 38. The outside portion 30 further includes an outwardly and upwardly extending angle portion 40 which, at its proximal end 42, is connected to the lower edge 34 to define a mouth since the distal edge 46 is spaced from the outside surface 46 adjacent the upper edge 32. Between the angled portion 40 and the outside surface 46 there are side panels 50 and 52 whereby an upwardly opening pocket 53 is defined. A leveler means in the form of a bubble gauge 60 may be provided for positioning the pad 16 in level relationship on a wall. Referring now to the pad 22 on the picture frame 14, see FIG. 5, it is seen that it also includes a main body portion 70, carrying a double-sided pressure sensitive tape 72 with the outer adhesive side 74 provided with a removable liner 76. From the body portion 70 adjacent the upper edge 80 there is an outwardly and downwardly extending portion 82 which is sized for receipt in the pocket 53 or socket of the wall pad. Once again, a leveler means 84 may be provided on the picture frame pad. In use, a pad is applied to the wall at a correct height after it has been leveled by removing the liner and adhering it to the wall by pressing it tightly to it, the adhesive being one of the type which responds to such pressure by adhering firmly. Thereafter, a similar operation is applied to the picture frame pad and, thereafter, the two are arranged in hooked-up relation as shown in FIG. 6 so that the picture will hang level and may be so positioned quickly, conveniently and readily.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent apparatus and articles.

What is claimed:

1. A hanging device comprising a wall pad having an adhesive surface and an oppositely facing main surface, said adhesive surface being lined with a removable waxed paper, said opposite surface having an upper edge, a lower edge, and side edges, and outwardly extending angled portion defining a mouth between the portion and the outside surface comprising an open pocket, and a leveler means in the form of a bubble gauge on said opposite surface comprising leveling means for leveling the pad, and a companionate device for hooked-up engagement, said companionate device comprising a pad having an outwardly downwardly extending portion for hooked-up engagement with said portion and means for attaching said device to a picture frame for use in mounting the picture frame to a wall.

2. The device as set forth in claim 1 wherein said device includes a pocket which is foldable out of said wall pad.

3. The device as set forth in claim 1 wherein said device is composed of rigid plastic material.

* * * * *